United States Patent [19]

Rozmus

[11] 4,125,936

[45] Nov. 21, 1978

[54] COMPOSITE STRIP FOR FABRICATING SPRING CONTACTS

[76] Inventor: John J. Rozmus, 1030 Derwydd La., Berwyn, Pa. 19312

[21] Appl. No.: 829,661

[22] Filed: Sep. 1, 1977

[51] Int. Cl.[2] ..... H01R 9/00

[52] U.S. Cl. ..... 29/630 C; 29/509; 228/136

[58] Field of Search ..... 29/509, 630 C; 228/243, 228/136, 155

[56] References Cited

U.S. PATENT DOCUMENTS

| | | | |
|---|---|---|---|
| 2,715,169 | 8/1955 | High | 29/630 C X |
| 2,961,762 | 11/1960 | Clark et al. | 29/630 C |
| 3,586,808 | 6/1971 | Shibata et al. | 29/630 C |
| 4,021,765 | 5/1977 | Kozacha et al. | 29/509 X |

*Primary Examiner*—Leon Gilden

*Attorney, Agent, or Firm*—Frederick J. Olsson

[57] ABSTRACT

Roll of a composite strip can be purchased by spring contact fabricator and fed directly into press for stamping contacts. Composite strip made as follows: Base or body strip fed out of a roll and continuously skived or milled to form slot extending along strip axis and having edge projections. Precious metal contact strip fed out of a roll and inserted into the slot and seam welded to body strip. Projections are then rolled over on contact strip compressing same in slot. Part of precious metal surface left exposed for making electrical connection. Composite strip wound into roll for shipment.

4 Claims, 21 Drawing Figures

Figures 1, 2:
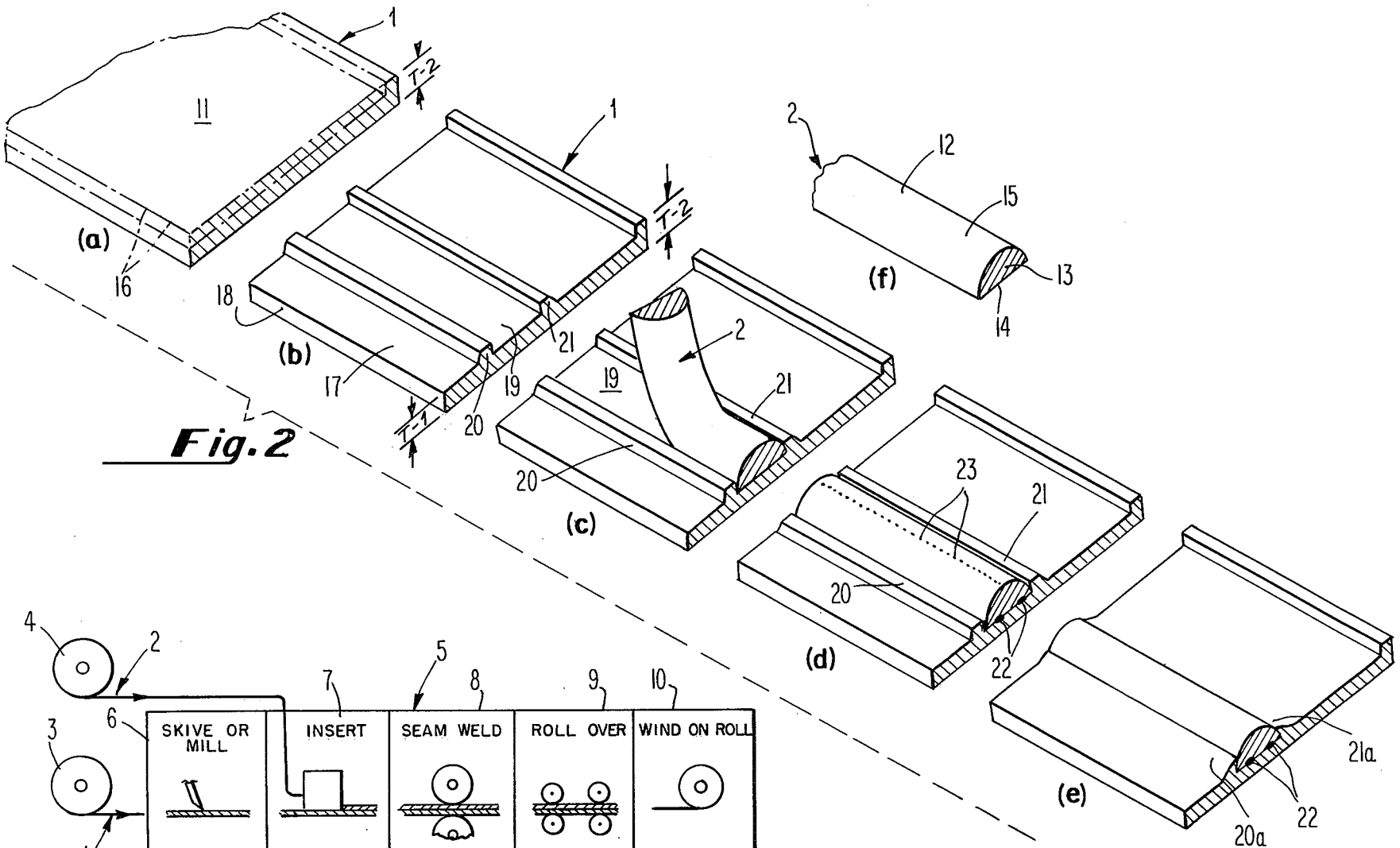

1
15
13
21
19
2
20
17
(a)
1
21
15
20
22
17
(b)
1
21a
15
20a
22
17
(c)

27
24
25
(a)
24
29
27
28
(b)
29'
28'
(c)

33
36
35
31
34
(a)
33
35
34
(b)
33
35a
34a
(c)

40
43
41
44
(a)
44
42
46
45
(a)
45
44
46
43
43a
(b)
44a
(b)

COMPOSITE STRIP FOR FABRICATING SPRING CONTACTS

This invention relates to the fabrication of metal spring contacts of the type having a spot of precious metal which makes the actual mechanical engagement with the mating conductor, for example, a conductor on an edge board connector. More particularly the invention relates to such contacts where the precious metal surface extends above the base metal surface so that only the precious metal is available to be engaged by a mating conductor.

At the present time, fabricators of raised precious metal spring contacts are supplied with various components which must be further processed and combined in various ways to form the contacts.

Typical examples of such components are rolls of alloy strip, rolls of precious metal contact strip, individual precious metal buttons or preforms, precious metal plating material and the like.

Depending upon the fabrication process, the various combinations of such components must be further worked or treated and then joined together. Conventionally, this requires large inventory, separate machines, repeated handling, large floor space, additional labor and the like and this adds to the cost of the contacts. Also, using conventional methods the fabricator has to be skilled in several technologies.

The foregoing problems of raised precious metal, spring contacts find significant solution in the methods shown in my patent 3,990,864. In the methods of the patent components supplied by the fabricator comprise only a body strip and a precious metal strip. These strips are fed to a progressive die wherein all operations are performed to fabricate the contacts. Those methods not only measurably reduce costs over conventional methods but also provide for high reliability.

However, in the spring contact fabricating sphere there is a need to further simplify the tooling and the operations of the fabricator to produce contacts of the kind disclosed in said patent yet provide for lower costs and high reliability. To satisfy this need the present invention provides a method whereby a fabricator can purchase a single component, namely, a roll of strip having integral base metal and precious metal and feed the composite strip into a press and stamp out such spring contacts.

According to the invention: a base metal strip is fed out of a roll and machined along its axis to generate a slot having projections extending along the opposite edges; a precious metal strip is fed out of a roll and inserted into the slot with the contact surface extending above the projections; optionally, the two strips are seam welded; the projections are then rolled over on the contact surface to firmly compress the strip in the slot leaving the precious metal surface exposed for contact with a mating conductor; and the composite strip is wound into rolls for shipment to fabricators.

The significant, practical contribution of the invention is that it provides a basis for the rapid fabrication of reliable, raised precious metal contacts of the kind mentioned with very substantial reduction in fabrication costs for same.

One advantage of the invention is that it permits a fabricator to mass produce raised precious metal spring contacts of the kind mentioned by purchasing a single component and employing a single technology and particularly one for which he is best suited; i.e. metal stamping.

Another advantage of the invention is that it provides for making a composite roll having a strip of base metal and a strip of raised precious metal mechanically captured by deformed metal to the base strip and conditioned so that the roll can be directly stamped into contacts of the same configuration and physical characteristics.

Another advantage of the invention is that it provides for making a composite roll having a strip of base metal and a strip of raised precious metal mechanically captured by deformed metal of the base strip which permits contacts to be contoured in the press to obtain optimum edgeboard-engagement positioning for the precious metal spot without developing ruptures which would make the contact highly vulnerable in hostile atmospheric conditions.

Another advantage of the invention is that it does not impose design limitations on the configuration of the spring contacts to be stamped from a composite roll because the cross sections of the base and precious metal strips can be widely varied to suit the need in question.

Another advantage of the invention is that it embodies operations which can be carried out on equipment set up in a multi-stage arrangement and performing on material continuously flowing from one stage to the other.

Another advantage of the invention is that it particularly lends itself to edge board spring contacts in as much as production requirements for a particular type of such contact conventionally will run in the tens of millions and this volume is desirably, economically compatible with the use of custom-made rolls of composite strip.

Figures 3, 4, 5, 6:
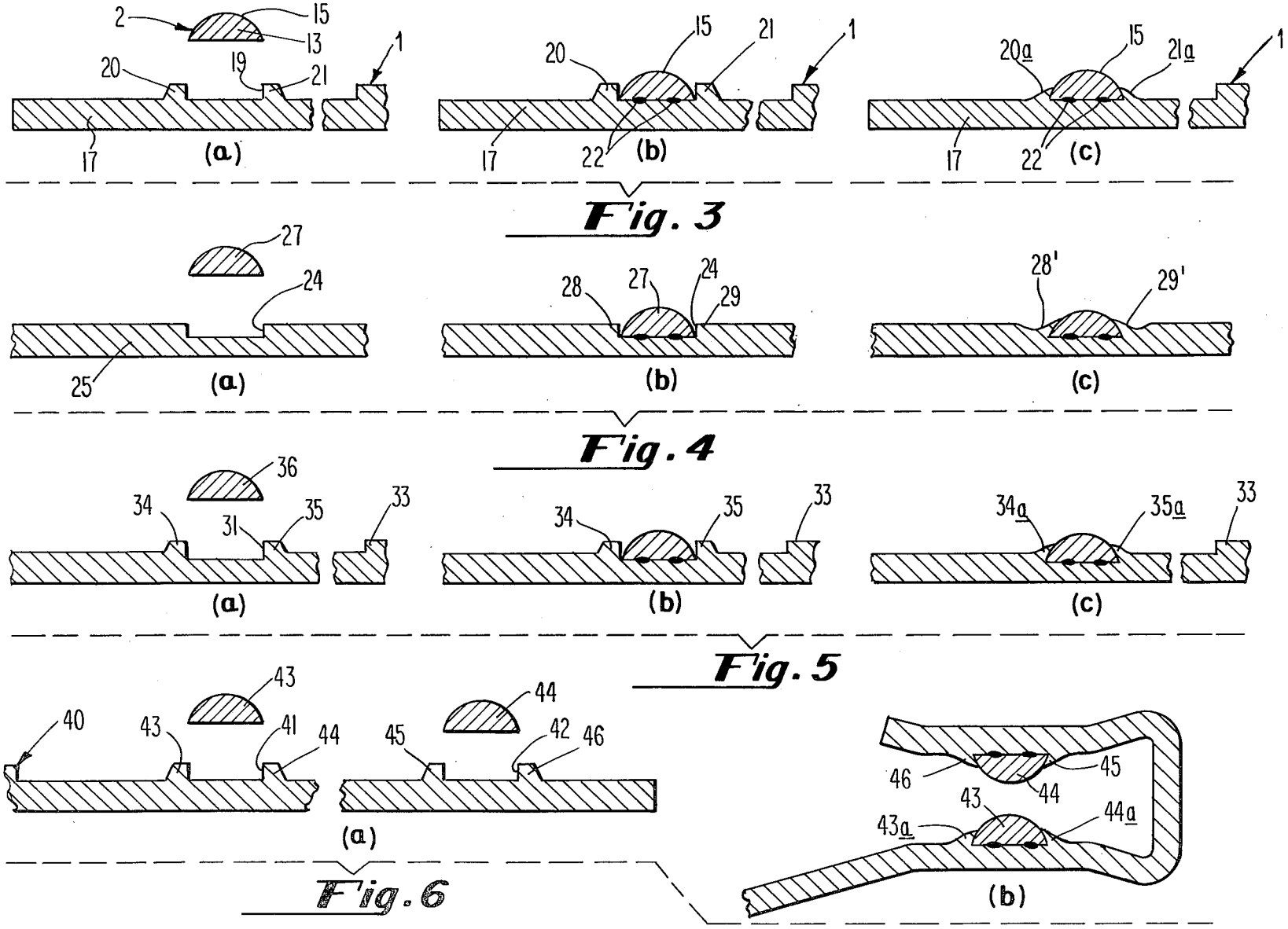

The methods of the invention will be described below in connection with the following drawings wherein:

FIG. 1 is a flow diagram illustrating the preferred over-all procedures of the invention;

FIGS. 2 (*a*) thru (*e*) diagramatically illustrate how the strips are worked in practicing the procedures of FIG. 1;

FIG. 3 parts (*a*) thru (*c*) diagramatically illustrate the cross section of the strips worked as in FIG. 1;

FIGS. 4 and 5 part (*a*) thru (*c*) are similar to FIG. 3 and illustrate alternative forming techniques;

FIG. 6 parts (*a*) and (*b*) illustrate the composite strip of the invention can be advantageously employed for the type of contact which normally is difficult and expensive to fabricate.

Metal working techniques of machining, rolling and seam welding are employed in fabricating the composite strip of the invention. Such techniques are, per se, well known in the art. However, insofar as I am aware none of these techniques have been employed in the manner of the invention, i.e. working base metal strip and working precious metal strip to shape and combine the same to produce a composite, raised precious metal strip. In the disclosure below I have not shown the details of equipment for machining, welding or rolling nor the tooling for the described way of shaping and manipulating the metal. Those skilled in the art will readily understand how to select the equipment and to specify the tooling once being informed of the particular shape and characteristics desired.

In FIG. 1, I have shown a flow chart which diagramatically illustrates the various steps employed in forming a composite roll of the invention.

A base or body strip is indicated at 1 and a surface or precious metal strip is indicated at 2. The body strip is wound into a roll 3 and the surface strip is wound into roll 4. The rolls 3 and 4 are mounted and associated with feed mechanism providing for the strips 1 and 2 to be continuously fed to equipment generally designated at 5. First, the strip 1 is machined with a slot by the equipment of box 6. Both of the strips are fed to equipment in box 7 wherein the strip 2 is inserted into the slot in strip 1. The combined strips are next fed to seam welding equipment in box 8 wherein the strips are fused together. The fused strip is then fed to a rolling mill of box 9 where the material on opposite sides of the slot is upset to extend over the strip 2 and compress the strip tightly in the slot and capture the same in position. From the rolling mill the composite strip is fed to equipment as in box 10 for winding the same into a roll.

In FIG. 2 I have diagramatically illustrated fragmentary portions of strips 1 and 2. It is believed that the use of small portions will make it more clear to those skilled in the art the manner in which the strips are to be worked to obtain the desired shape and characteristics.

FIG. 2 (*a*) a portion of base or body strip 1 is indicated at 11. As will be understood a typical strip is rectangular in cross section and has a thickness of approximately 0.028 inch and a width of 1 5/32 inches and is formed of copper alloy and tempered so as to have a spring-like quality.

A portion 12 of the contact or surface strip 2 is shown in part (*f*). The strip has a base 13 with a generally flat bottom 14 and a top contoured precious metal surface 15. For welding purposes, the bottom 14 has a pair of small axially extending v-shaped tips now shown. A typical strip has a width of approximately 0.035 inch and height of approximately 0.007 inch . The surface 15 is preferably gold inlayed on the base 13 with a thickness of not less than 0.00005 inch. The base 13 provides mechanical strength for the surface 15.

In some spring contacts the portion having the precious metal spot is substantially contoured. Normally, the strip is thinned out prior to the contouring operation so as to facilitate same. Thus, the finished spring contact has two distinct areas each of a different thickness. On the other hand, in other spring contacts the contoured section has the same thickness as the remainder of the contact.

The methods disclosed herein are applicable to either type of contact but are especially useful for the thinned out type because of the savings in fabrication time, handling and tooling. The composite strip formed as diagramatically illustrated in FIG. 1 is for use in stamping out contacts having a thinned out precious metal area.

Thus, referring to FIG. 1 part (*a*), the machining operation takes place in the area indicated by the dotted lines 16. Machining is continuous along the longitudinal axis of the strip 1.

Comparing parts (*a*) and (*b*) the machining operation forms the section 17 thickness T-1 which is less than the thickness T-2 of the strip 1. The thin section 17 extends from the edge 18 inwardly towards the center of the strip a distance commenserate with the dimensions of the contact to be formed.

Again referring to FIG. 1, part (*b*), it will be seen that the machining operation has formed a slot 19 and projections 20 and 21 on opposite sides of the slot. The slot and projections extend along the longitudinal axis. In the particular instance shown, the slot is formed depthwise by the lower portions of projections 20 and 21. The slot and projections are shown in side elevation in FIG. 3 part (*a*).

The surface strip 2 is now ready to be jooined with the body strip 1. This is started by inserting the strip 2 into the slot 19 as is indicated in FIG. 1 part (*c*) and FIG. 3 part (*b*). Note that the strip 2, the slot 19 and the projections 20 and 21 are dimensioned so that the precious metal contact surface 15 is spaced outwardly of the thin section 17 and of the projections 20 and 21. This is to insure that a substantial portion of the contact surface 15 is available or exposed for making an electrical connection.

After the strip 2 is inserted in the slot 19, the strips 1 and 2 are seam welded. In FIG. 2 part (*b*) I have shown the welding as by the dark areas 22 which illustrate that the base 13 and the bottom of the slot 19 are fused together. The weld points along the axis of the strip are indicated by the dots 23 in FIG. 1, part (*d*). For reasons pointed out later the welding step may be omitted.

The next step in the joining process is to roll the projections 20 and 21 so that they extend over in very tight engagement with the contact surface 15. The projections as deformed and rolled over onto the surface 15 is shown at 20*a* and 21*a* in FIG. 1, part (*e*) and in FIG. 3 part (*c*). Note that a substantial portion of the surface 15 remains exposed.

In FIGS. 4 and 5, parts (*a*), (*b*) and (*c*), I have illustrated alternative ways of forming a slot in the body strip and deforming the metal of the body strip to extend over and engage the contact surface of the surface strip.

The arrangement of FIG. 4 is desirably used where the roll is to be stamped into contacts of uniform thickness. In FIG. 4 it will be seen that the slot 24 is machined in the body strip 25. After the precious metal or surface strip 27 is inserted into the slot 24 and seam welded the sections 28 and 29 adjacent the opposite edges of the slot are up-set and rolled over to contact the precious metal surface 30 as noted at 28' and 29' in part (*c*).

In FIG. 5, the arrangement may be employed in heavy duty applications where additional contact material is required.

In FIG. 5, part (*a*), the slot 31 is milled substantially into the thin section 32 of base strip 33 while the projections 34 and 35 are on the top surface and project upwardly therefrom. The surface strip 36 is inserted in the slot 31, seam welded and the projections 34 and 35 are rolled over as indicated in part (*c*).

In FIG. 6 I have shown how the invention is applicable to contacts having two spots of precious metal which are respectively adapted to engage conductors on the opposite sides of an edge board.

In part (*a*) the base strip 40 is machined as heretofore described except that a pair of slots 41 and 42 are formed. A pair of contact strips 43 and 44 are then inserted into the slots, seam welded and the projections 43/44 and 45/46 are rolled over. The form of the contact stamped from the strip is shown in part (*b*) where it will be seen that the precious metal contact surfaces face one another and will engage conductors on opposite sides of an edge board connector.

With the above description in mind, it is appropriate to comment on the machining, seam welding and rolling operations.

The machining operations is carried out by skiving or milling. Because of obtainable speeds, skiving is preferred to milling. Machining by rolling is possible but this type of operation raises problems with respect to distortion of the strip.

With respect to welding, this operation develops, as noted above, one or more fused areas (depending upon the number of welding tips) between the bottom of the slot and the bottom of the contact strip. Such a fused area provides an electrical path and a mechanical joint. Also, the area, per se, tends to resist the effects of chemical action such as corrosion and so retains the conduction path in the mechanical joint. Welding, however, is not without attendant disadvantages. By virtue of one or more of the tips on the bottom of the contact strip, the bottom is just slightly spaced from the bottom of the slot. Some spacing exists after the welding operation. This spacing condition is undesirable as it provides a medium within which chemical action of moisture and ambient pollutants can start corrosion of the contact. In the present invention the spacing condition is ameliorated as noted hereinafter.

It will be appreciated, therefore, that there are applications for contacts where welding is desirably employed, for example, in hostile environments where corrosion is highly likely or where (since the IR drop is neglibible) the weld can be available as a fail-safe conductor means where there is a possibility power levels may fall off to abnormally low value. Conversely, where such conditions do not exist the welding operation may be eliminated.

Referring to the rolling operation, this is carried out so that the deformed metal of each projection (or the opposite sides of the slot) tightly engages and bears down on the precious metal surface to push the strip into the slot whereby it is compressed on the sides and on the bottom.

The deformed metal is pressed on the precious metal surface to establish several important conditions which will be carried over into the stamped contacts: the air space between the sides and bottom is eliminated and so the opportunity for chemical action is commensurately reduced; the strip is captured or locked into position, a good electrical path between the strips is set up; and a guide is provided for the edge of an edge board connector so that the board conductor makes a desired contact with the precious metal. The foregoing conditions are established both with and without the welding operation. Where the strips are welded, the fused areas are compressed along with the strip down on the bottom of the slot.

As will be understood the deformed metal and the precious metal can be hit by appropriately shaped punches in the press to enhance the above conditions.

Before closing, two other items should be mentioned.

The tooling for inserting the strip in the slot is along the lines of that shown in my patent 3,990,964 and normally such tooling is positioned at the entrance to the seam welder.

With respect to the body strip 1 and the contact strip 2, it will be understood that the same should be conditioned to have compatible expansion and contraction characteristics. Both are made from conventional copper alloy and necessarily have substantially the same coefficient of expansion. This satisfies the foregoing condition. As pointed out in my patent 3,990,021 this condition will avoid loosening of the composite parts in the stamped contact. Looseness is highly undesirable from the standpoint of conductivity, mechanical entrapment and chemical stability.

I claim:

1. The method of making a composite metal strip to be fed to die means for stamping electrical contacts:

providing a roll of metal body strip;

providing a roll of metal surface having a precious metal contact surface;

feeding said strips out of the rolls and performing the following operations on the strips:

(a) machining a slot along the longitudinal axis of the body strip;

(b) inserting the surface strip in said slot with the contact surface spaced outwardly of the body strip to provide for exposure of a substantial portion of the contact surface;

(c) seam welding the surface strip and the body strip;

(d) roll deforming the respective opposite edges of the slot to cause the deformed metal to extend over and tightly engage and bear down on portions of said contact surface while maintaining said exposure;

moving said strips along said axis while repeating said steps (a) thru (d) on the strips until said steps are being simultaneously executed and the composite strip is being continuously formed; and winding the composite strip into a roll.

2. The method of making a composite metal strip to be fed to die means for stamping electrical contacts;

providing a roll of metal body strip;

providing a roll of metal surface strip having a precious metal contact surface;

feeding said strips out of the rolls and performing the following operations on the strips;

(a) machining a slot along the longitudinal axis of said body strip including a pair of projections respectively extending upwardly from the strip on opposite sides of the slot;

(b) inserting the surface strip in said slot with the contact surface spaced outwardly of the projections and of the body strip to provide for exposure of a substantial portion of the contact surface;

(c) seam welding the surface strip and the body strip;

(d) roll deforming said projections to cause the deformed metal thereof to extend over and tightly engage and bear down on portions of said contact surface while maintaining said exposure;

moving said strips along said axis while repeating said steps (a) thru (d) on the strips until said steps are being simultaneously executed and a composite strip is being continuously formed; and winding the composite strip into a roll.

3. The method of making a composite metal strip to be fed to die means for stamping electrical contacts:

providing a roll of metal body strip;

providing a roll of metal surface strip having a precious metal contact surface;

feeding said strips out of the rolls and performing the following operations on the strips:

(a) machining a slot along the longitudinal axis of the body strip;

(b) inserting the surface strip in said slot with the contact surface spaced outwardly of the body strip to provide for exposure of a substantial portion of the contact surface;

(c) roll deforming the respective opposite edges of the slot to cause the deformed metal to extend over and tightly engage and bear down on portions of said contact surface while maintaining said exposure;

moving said strips along said axis while repeating said steps (a) thru (c) on the strips until said steps are being simultaneously executed and the composite strip is being continuously formed; and winding the composite strip into a roll.

4. The method of making a composite metal strip to be fed to die means for stamping electrical contacts;

providing a roll of metal body strip;

providing a roll of metal surface strip having a precious metal contact surface;

feeding said strips out of the rolls and performing the following operations on the strips:

(a) machining a slot along the longitudinal axis of said body strip including a pair of projections respectively extending upwardly from the strip on opposite sides of the slot;

(b) inserting the surface strip in said slot with the contact surface spaced outwardly of the projections and of the body strip to provide for exposure of a substantial portion of the contact surface;

(c) roll deforming said projections to cause the deformed metal thereof to extend over and tightly engage and bear down on portions of said contact surface while maintaining said exposure;

moving said strips along said axis while repeating said steps (a) thru (c) on the strips until said steps are being simultaneously executed and a composite strip is being continuously formed; and winding the composite strip into a roll.

* * * * *